United States Patent [19]

Ernst

[11] 4,171,048

[45] Oct. 16, 1979

[54] PLASTIC BAG CONSTRUCTION IN SERIAL ROLL FORM

[76] Inventor: Edwin F. Ernst, 3722 Buckingham Dr., Roanoke, Va. 24018

[21] Appl. No.: 841,441

[22] Filed: Oct. 12, 1977

[51] Int. Cl.[2] ..... B65D 31/10

[52] U.S. Cl. ..... 206/390; 229/69

[58] Field of Search ..... 206/390, 820; 229/53 R, 229/58, 69

[56] References Cited

U.S. PATENT DOCUMENTS

| | | | |
|---|---|---|---|
| 3,113,715 | 12/1963 | Pangrac | 229/53 |
| 3,254,828 | 6/1966 | Lerner | 229/53 |
| 3,395,622 | 8/1968 | Kugler | 229/53 |
| 3,473,724 | 10/1969 | Coverstone et al. | 229/53 |
| 3,640,450 | 2/1972 | Lieberman | 229/53 |
| 3,682,051 | 8/1972 | Sengewald | 206/390 |
| 3,719,318 | 3/1973 | Moran | 229/58 |
| 3,966,524 | 6/1976 | Lehmacher | 206/390 |

FOREIGN PATENT DOCUMENTS

| | | | |
|---|---|---|---|
| 2242440 | 5/1973 | Fed. Rep. of Germany | 206/390 |

*Primary Examiner*—Herbert F. Ross
*Attorney, Agent, or Firm*—Staas & Halsey

[57] ABSTRACT

A plurality of expandable bags are serially connected lengthwise in roll form. Each bag is of substantially long length and has an expandable gusset near one end thereof and traversely of the length. The gusset end of each bag is respectively connected to the filling or open end of the next bag by perforated or weakened structure. Various modifications of the position of the opening are incorporated. Also, the bags are rolled into serial form in a compact package for distribution and use with the gusset and opening portions of each bag being rolled inwardly to the inside of the roll, or outwardly to the outside of the roll. The method of making these serially connected bags in roll form is also included.

15 Claims, 10 Drawing Figures

PLASTIC BAG CONSTRUCTION IN SERIAL ROLL FORM

BACKGROUND OF THE INVENTION

1. Field of the Invention

This invention relates generally to articles of manufacture wherein expandable bag structure is provided in a form which is easy and simple to use.

2. Description of the Prior Art

The common problem with known type bag construction is that the expandable portions thereof, are normally along the sides thereof. This is fine for some types of applications, but does not meet the requirements of many others.

Another problem with known type devices which have exapandable sections at the bottom of the bag is that unnecessary folds and complicated construction steps, as well as complicated overlaps are necessary to achieve the desired product.

Another very serious problem with expandable structures is that they cannot be connected together along the portions of expansion. That is, normally the bag structures are connected at areas which are non-expandable, and the expandable areas are the portions which are free from each other.

Known prior art patents which have one or more of the foregoing problems are as follows: a patent to Bohner et al, U.S. Pat. No. 3,651,615, teaches the method of making packages a metal-foil-polyethylene laminate in groups for later convenient use. However, these groups are side-by-side rather than longitudinal in series and therefore do not meet the applicant's disclosed invention. A patent to Piazze, U.S. Pat. No. 3,618,478, shows a bag-making apparatus with the bag per se having a reinforced bottom. The bag is made of plastic and the bottom is gussetted. The patent to Guenther, U.S. Pat. No. 3,662,278, shows a method and apparatus for making interconnected bags having individual closure flaps and bottom gussets. Perforated seal lines are provided between each of the respective bags. However, again these bags are not connected in serial form with the bottom gussets for each respective bag being connected to the top opening of the adjacent bag. A patent to Maccherone, U.S. Pat. No. 3,534,666, shows bags which are clearly connected, but are again connected in side-by-side relationship, rather than end to end as in subject invention. A patent to Kincaid, U.S. Pat. No. 3,060,075, discloses another apparatus for producing continuous bag stock wherein serially connected bags are rolled up for distribution and later use. However, the bags are provided with side gussets rather than end gussets. This is an important distinction between the prior art and applicant's invention.

The applicant is well aware of bag construction having side gusset expansion structure connected in serial form, but end gussets traversely to the length of the serially connected devices is believed to be new and novel.

SUMMARY OF THE INVENTION

An object of the present invention is to provide bag construction in serial roll form having traverse gusset pockets for expansion of each individual bag when put into use.

Another object of the present invention is to provide a method of making serially connected multiple bags which are packaged in roll form for easy distribution and later use thereof. The method also includes providing traverse expandable gusset structure when forming said bags in serial roll form.

A further object of the invention is to form a plurality of bags which have bottom gussetted portions provided with each bag, and each said portion being attached to an adjoining bag by a weakened portion so that as each bag is filled and expanded in use, the weakened portion may be easily severed.

A still further object of the present invention is to provide serially connected expandable gusset bag structure wherein the expandable portions are attached closely adjacent to a filling opening of the next bag, and said plurality of bags are wound into a roll with the gussets and filling openings being on the outside circumference of the roll while being wound and upon completion thereof.

A still further object of the present invention is to provide serially connected expandable gusset bag structure wherein the expandable portions are attached closely adjacent to a filling opening of the next bag, and said plurality of bags are wound into a roll with the gussets and filling openings being on the inside circumference of the roll while being wound and upon completion thereof.

The invention disclosed herein includes bag construction of plastic or similar material of substantial longitudinal shape having an expandable bottom gusset which is traverse to the length of each bag, with the other end of each bag provided with a filling opening for later use thereof. The bottom gussetted area of one bag is closely attached to the filling opening of the next bag by a weakened connecting portion to permit ready detachment and separation thereof when the bags are put into use.

Another important feature of this invention is in the method of making the aforesaid structure. Also various modifications of same are disclosed wherein the gussets and bag openings are wound into roll form with all of said gussets and openings facing to the outside of the package when completed. A similar embodiment involves winding the serially connected bag structures into a roll with all of the expandable gussets and filling openings facing to the inside of said package.

Other modifications involve the filling openings being very close to the bottom gussets of each adjacent bag, while a variation thereof is to have the bag opening provided with an offset portion which is slightly spaced away from the gusset portion of the next bag. While the side edges of the respective bag structures are normally sealed from gusset area to filling area, the omission of edge sealing near the opening portion is envisioned for the purpose of providing a small lip at the filling opening for ease and assistance during a subsequent filling operation.

Another embodiment envisions having both the edge sealing and the bag opening portion substantially spaced from the adjacent gusset expandable portion of the next bag so as to provide an extension flap near the opening of each respective bag for the purpose of tucking same in after a filling operation. Again, an opening lip portion may be provided in this embodiment by finishing the edge sealing before completely reaching the end of the opening for each bag structure.

While preferred material for use in making the bag structure of this invention is plastic, paper and foil with a heat seal coating provided thereon also is envisioned.

In the method of making the article of manufacture of this invention, a roll of plain or printed material of indeterminate length is provided for the base member of the product. Another roll of indeterminate length material supplies the second portion of the bag structure. The second portion of the bag structure is appropriately cut or perforated to produce short pieces of material of desired bag length. One end of each of the pieces of second material are appropriately secured in appropriate position on the first longitudinal member by heat sealing, pressure sealing or adhesive or glue-type sealing. After the initial end of each second member is positively attached and secured in appropriate position on the indeterminate length first member, an appropriate Z-fold or gusset will be formed in the second member closely adjacent the attaching line. The outer side edges of the Z-fold end gusset will normally be heat sealed to maintain the fold and relative position of the first and second longitudinal members. The outer side edges of the respective elongated first member and the associated second member will then be side edge sealed to securely hold the two members together and to complete the basic formation of a bag structure. As explained in detail below, various types of filling openings with or without lips or end flaps may be formed at this point.

The roll material of indeterminate length which supplies the first member now has a plurality of second members firmly attached on one side thereof by the aforedescribed steps. Another step is now normally included for producing a weakened portion between adjacent bag structures by perforating the main member of indeterminate length at the points between the filling opening of each bag and the bottom gusset area of the adjacent bag. After the perforation or other weakening step, a final step of winding the serially connected bags up into roll form is performed. The embodiments of this step are now disclosed herein. The first involves winding the strip of indeterminate length up into package form with the gussets and filling openings being on the outside circumference thereof so that when the final package is completed all of the gussets and fillings are on the outside of the layer of indeterminate length to which they are secured. This will permit the roll when put to end use, to unwind with the filling openings and expandable bottom gussets being especially accessable and ready for filling.

Another embodiment includes the winding of the strip of indeterminate length into a roll package wherein the gussets and filling openings are to the inside of the roll package. This has some advantages in that the filling openings and gusset expansion portions are fully protected per se by the other strip of indeterminate length. This is especially advantageous for the outermost layer which if an outer covering is not used for the roll package, could become injured or harmed in the shipment thereof or later distribution thereof.

While the roll of material of indeterminate length for the first member and similarly the roll of material for providing the second shorter members as set forth above may be of plain material, this invention also encompasses the including of printing matter on said material prior to the use thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
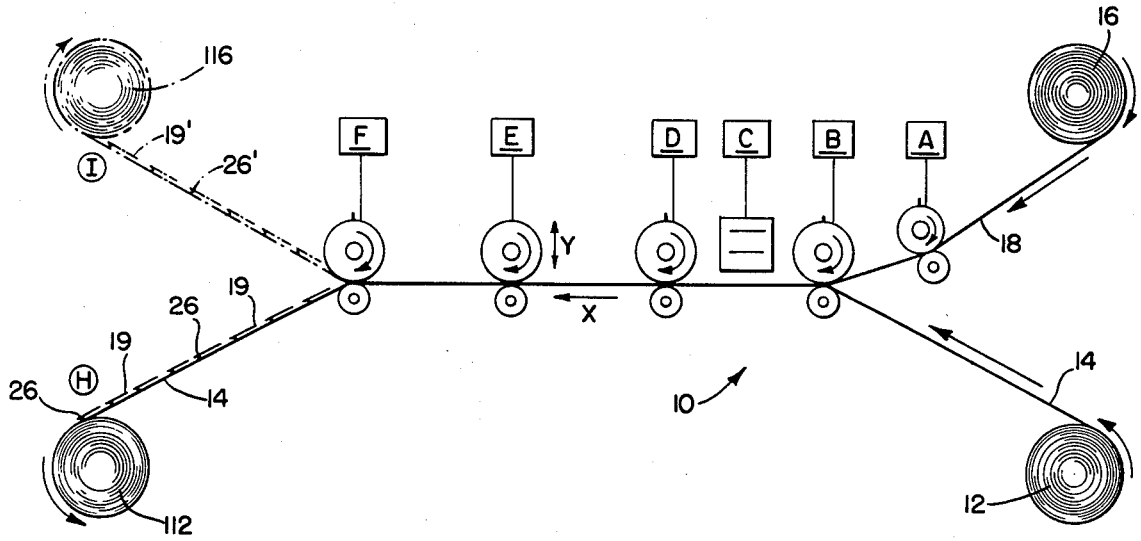
FIG. 1 is a schematic view of the manner of making the article of this invention.

Looking at FIG. 1 of the drawings, reference numeral 10 indicates in block and schematic form the manner of making the article of manufacture of this invention. A first roll 12 of material of indeterminate length provides same as shown by reference numeral 14 to a first station B. This roll of material may be plain, or may be provided with printed material, stenciled material, embossed material or the like thereon as supplied in the roll form 12. The material is preferably of plastic, but paper or foil material may also be used, especially if provided with heat seal or adhesive seal type coatings.

Figure 2:
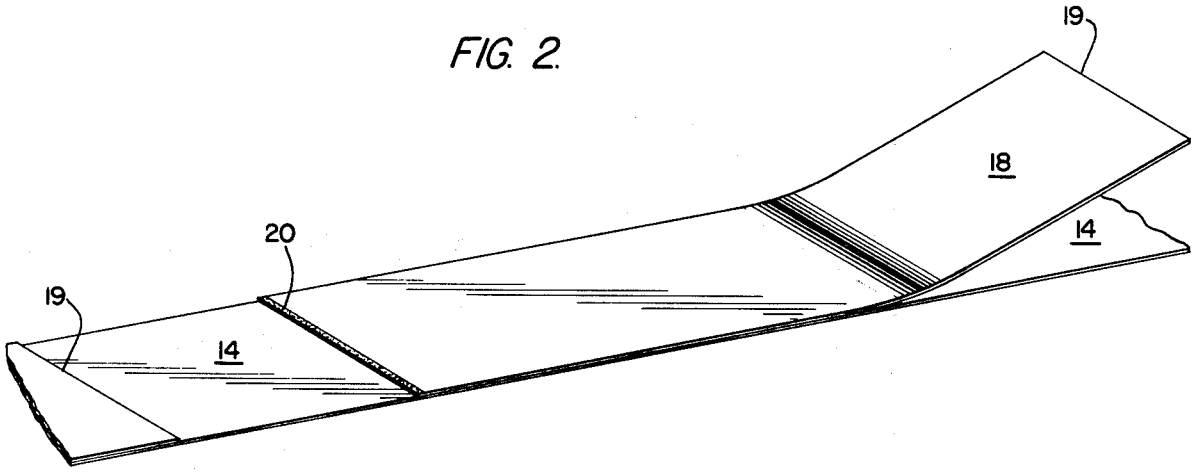
FIG. 2 is a perspective view of one embodiment of this invention.

Another roll of material of indeterminate length, similar to that of roll 12 is provided at 16. The length of material 18 is fed to a station A where this second material may be cut into appropriate shorter lengths, each short length is in turn attached with the appropriate portion of the first material 14 at station B. At station B the leading edge of each section of material 18 is appropriately attached to the member 14 of indeterminate length. This attachment is preferably along the complete width of the two materials, that is traversely of the length thereof and may be by heat sealing, glue or adhesive sealing, or any other fast and efficient manner of firmly attaching short lengths of the second member 18 to the continuous and indeterminate length of first member 14. The attaching step of station B may best be seen in the perspective of FIG. 2 wherein the line attachment contact is indicated by reference numeral 20. The first member material of indeterminate length 14 is clearly visible in this figure as well as the shorter lengths of the second material 18. The trailing edges 19 of the second member 18 may clearly be seen and are the edges which will form the filling openings of the respective bags.

Figure 3A:
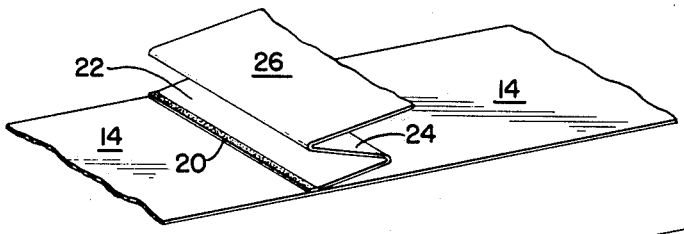
FIG. 3A is a perspective view of a step in the method of making the device of this invention.
Figure 3B:
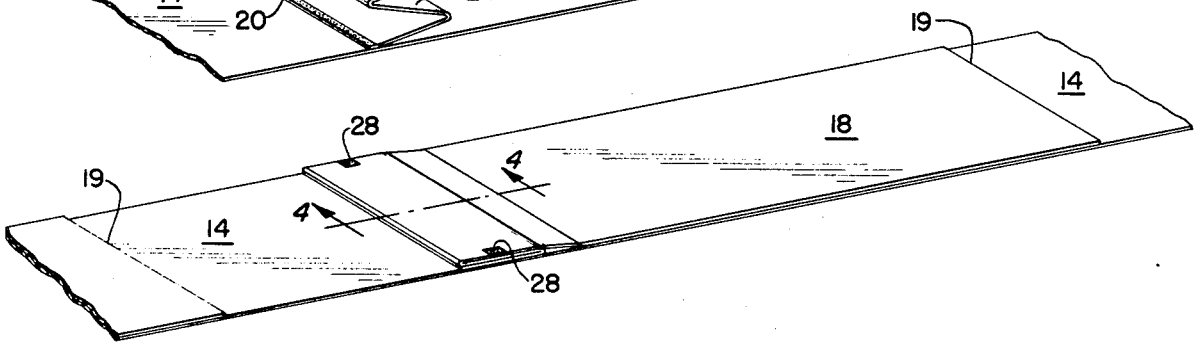
FIG. 3B is a perspective view of the completion of the step shown in FIG. 3A.
Figure 4:
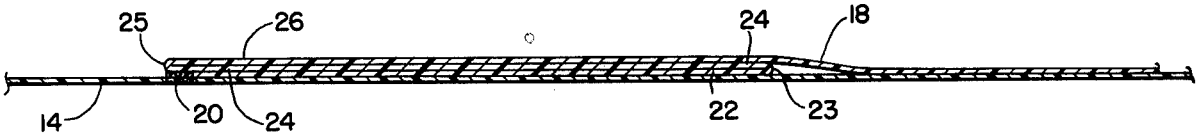
FIG. 4 is an elevational view in cross section taken along line 4—4 of FIG. 3B.

FIG. 3A shows the gusset forming step which takes place at station C in FIG. 1. As can be seen in FIG. 3A, a Z-type fold is provided in the attached end of the member 18. This Z-type fold normally consists of portions 22, 24 and 26, but may include more folds than this for some type of applications. After the expansion gusset 22, 24, 26 is formed, preferably the outer side edges thereof are tack sealed at 28 to maintain the proper formed gusset shape. FIG. 3B shows these gusset edge tacks which may be performed by station D of FIG. 1. As best seen in FIG. 4, the Z and gusset fold between portions 22, 24 and 26 are provided by the folds at lines 23 and 25.

Figure 5:
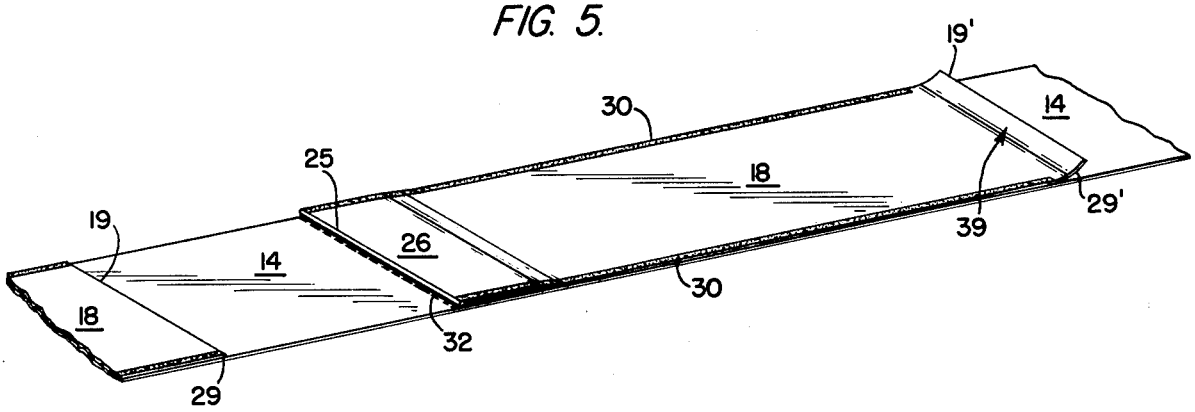
FIG. 5 is a perspective view of the serial form of the device of this invention after a perforating step.

The flow arrow X in FIG. 1 shows the continuous path of flow of the first indeterminate length member 14 as the various steps of making the article proceed. The flow lines Y, indicated by the double arrows, indicate the operation of station E. Station E provides for the edge sealing of the first elongated member 14 and the shorter bag panel members 18. This edge sealing is best seen in FIG. 5 of the drawings. Once the side edges 30 are securely sealed together the bag structure is substantially completed.

As shown in FIG. 5 the side edge sealing normally will occur along the edges 30 and include the portion 29 shown in the left of said figure. However, a slight modification of this embodiment involves finishing of the edge sealing 30 slightly short of the end 19 of the second member 18. This is shown at the right of the FIG. 5, and indicated by 19' and 29'. With this modification a lip 39 of approximately a quarter inch or so is provided in the member 18 adjacent the filling opening of the completed bag structure. While the bag opening 19, 29 at the left of FIG. 5 is entirely sufficient for many applications of these bags, it has found by the inventor that in some applications the lip 39 as depicted in the right of FIG. 5 offers a number of advantages. Such as increased ease and simplicity in filling the respective bags by an end user of the package of this invention.

In order to provide a weakened portion between the filling opening end of each bag and the gusset expansion end of the next adjacent bag a line of perforations 32 may advantageously be provided in the first member of indeterminate length 14. Station F in FIG. 1 is provided for this step. After the perforations 32 are provided, the plurality of serially connected completed bag structures, as depicted in FIG. 5, are now ready for winding into completed package form. As seen in FIG. 1, a preferred winding occurs onto takeup 112. As indicated by reference character H, when the first member 14 of indeterminate length is wound upon the takeup roll 112, the completed bag structures are to the outside of the roll. That is, the gussets 22, 24, 26 and the filling openings 19 are wound upon the roll 112 to the outside thereof. This has a number of desirable advantages for the ultimate end users of the package roll, i.e., ease of filling and the like.

However, as can be seen in dotted line form in the upper left-hand portion of FIG. 1, an alternative method I of winding the serial connected bags of this invention is to wind same onto takeup roll 116 with the gussets 26 and 19 wound toward the inside of said roll with the layer 14 to the outside thereof. This offers some advantages in overall protection of the bag structure, especially if the package roll is merely tied or fastened at the end thereof, and shipped without an outer covering thereover.

Figure 6B:
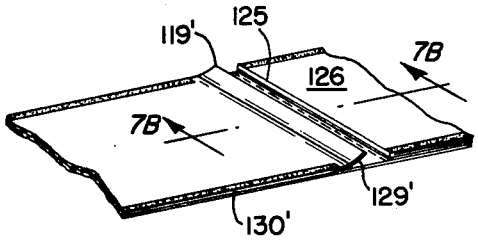
FIG. 6A is a perspective view of a second embodiment of the article of this invention and FIG. 6B shows a modification of this second embodiment.
Figure 6A:
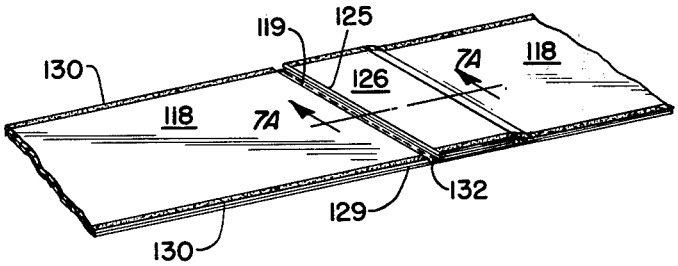

Another embodiment of this device is shown in FIG. 6A, while FIG. 6B shows a slight modification to this second embodiment. As seen in FIG. 6A, the bag opening 119 is arranged to be very close to the bottom gusset portion of the next adjacent bag with the perforations 132 being provided in the small gap therebetween. Also as may be noted in FIG. 6A, the bag filler opening 119 has the side edges thereof 129 sealed completely to the ends of said edges as a continuation of the side edge seals 130. In FIG. 6B, the modification of this second embodiment, similar to the modification discussed above in FIG. 5, is also provided. That is, the side edges 130' have a short portion 129' which is not sealed so as to provide the lip 119' at the filler opening end of each bag. The same desirable benefits as already discussed are provided by this small lip.

Figure 7B:
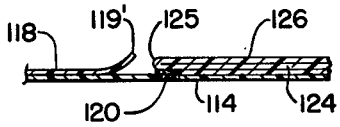
FIGS. 7A and 7B are cross sectional elevations of the respective FIGS. 6A and 6B taken along lines 7A—7A and 7B—7B thereof.
Figure 7A:
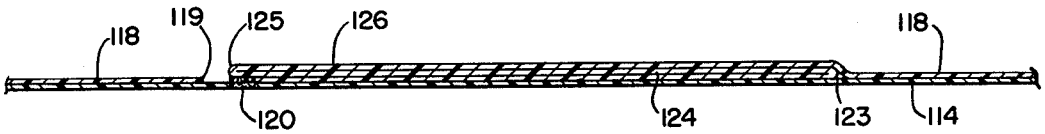

FIG. 7A shows in cross section the second embodiment, as depicted in FIG. 6A, with no extra flexible lip at the bag opening being present. While FIG. 7B shows in cross section the modification providing said lip. Also in the cross section of FIG. 7A, the line seal 120 for the second member 118 as attached to the longitudinal member 114 of indeterminate length may be seen. The cross section of FIG. 7B shows the modification with the lip 119 being slightly raised for emphasis and clarity of showing.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article of manufacture comprising:

means for providing a roll package containing a plurality of expandable bag structures connected in serial manner, each individual bag structure having gusset means at one end thereof to permit expansion thereof when said bag structure is put into use, each individual bag structure also having an opening means at the other end thereof, both the said gusset means and the said opening means being traverse to the length of the plurality of serially connected bag structures, and the gusset means of each individual bag structure being near the opening means of the next individual bag structure, each gusset means being of at least a three panel traverse fold with the side edges sealed together along the side edges of said roll.

2. The structure set forth in claim 1, wherein the traversely positioned gusset means and the traversely positioned opening means are provided closely adjacent each other in the serially connected form.

3. The structure set forth in claim 2, wherein each of the traverse opening means is provided with a small movable lip portion for ease of filling of each bag when put into use.

4. The structure set forth in claim 1, wherein the traversely positioned gusset means and the traversely positioned opening means are spaced a distance apart in order to provide a flap portion associated with said opening means.

5. The structure set forth in claim 4, wherein the traversely positioned opening means is also provided with a movable lip portion for ease in filling of each individual bag structure when put into use.

6. The structure set forth in claim 1, wherein the means for providing a package roll of a plurality of serially connected expandable bag structures includes the package rolled so that the traversely positioned gusset means and the traversely positioned opening means face towards the outside of the package roll.

7. The structure set forth in claim 1, wherein the means for providing a package roll of a plurality of serially connected expandable bag structures includes the package rolled so that the traversely positioned gusset means and the traversely positioned opening means face towards the inside of the package roll.

8. The structure set forth in claim 6, wherein the traversely positioned gusset means and the traversely positioned opening means are closely adjacent each other between the individual serially connected bag structures.

9. The structure set forth in claim 8, wherein a small deflectable lip portion is provided for each of the traversely positioned opening means for ease in filling of each individual bag structure when put into use.

10. The structure as set forth in claim 6, wherein the traversely positioned gusset means and the traversely positioned opening means are spaced a short distance apart to provide a flap associated with said opening means.

11. The structure set forth in claim 10, wherein the traversely positioned opening means of each individual bag structure is provided with a small deflectable lip portion for ease in filling of each individual bag structure when put into use.

12. The structure as set forth in claim 7, wherein the traversely positioned gusset means and the traversely positioned opening means are provided closely adjacent to each other as the individual bag structures are connected in serial form.

13. The structure set forth in claim 12, wherein each of the traversely positioned opening means is provided with a small deflectable lip portion for ease in filling of the individual bag structures when put into use.

14. The structure as set forth in claim 7, wherein the traversely positioned gusset means and the traversely positioned opening means of the individual bag structures connected in serial form are spaced a short distance apart from each other to provide a flap associated with each of said opening means.

15. The structure as set forth in claim 14, wherein each of said traversely positioned opening means is provided with a small deflectable lip portion for the purpose of making the filling of each individual bag structure easier when put into use.

* * * * *